US008249286B2

(12) United States Patent
Nault

(10) Patent No.: US 8,249,286 B2
(45) Date of Patent: Aug. 21, 2012

(54) INTERCONNECTING EARPHONES

(75) Inventor: Brad Nault, Milwaukee, WI (US)

(73) Assignee: Koss Corporation, Milwaukee, WI (US)

( * ) Notice: Subject to any disclaimer, the term of this patent is extended or adjusted under 35 U.S.C. 154(b) by 423 days.

(21) Appl. No.: 12/546,328

(22) Filed: Aug. 24, 2009

(65) Prior Publication Data

US 2011/0044487 A1 Feb. 24, 2011

(51) Int. Cl.
*H04R 25/00* (2006.01)

(52) U.S. Cl. ..... 381/380; 381/182; 381/370; 381/374; 381/383

(58) Field of Classification Search ..... 381/182–186, 381/309, 374, 380, 383; D14/205, 223
See application file for complete search history.

(56) References Cited

U.S. PATENT DOCUMENTS

| | | | | |
|---|---|---|---|---|
| 5,339,461 | A | 8/1994 | Luplow | |
| 5,845,197 | A * | 12/1998 | Hada et al. | 455/569.1 |
| 6,370,401 | B1 | 4/2002 | Baranowski et al. | |
| 6,374,126 | B1 * | 4/2002 | MacDonald et al. | 455/569.1 |
| 6,909,050 | B1 | 6/2005 | Bradford | |
| 7,436,974 | B2 * | 10/2008 | Harper | 381/374 |
| D602,004 | S * | 10/2009 | Matsuoka | D14/223 |
| 7,610,661 | B2 * | 11/2009 | Sween et al. | 24/129 R |
| 7,693,295 | B2 * | 4/2010 | Harper | 381/374 |
| 2005/0238195 | A1 | 10/2005 | Wei | |
| 2006/0008106 | A1 | 1/2006 | Harper | |
| 2007/0053541 | A1 | 3/2007 | Kuo | |
| 2007/0230735 | A1 * | 10/2007 | Sung et al. | 381/374 |
| 2008/0089544 | A1 | 4/2008 | Ito | |
| 2008/0159579 | A1 | 7/2008 | Park | |
| 2008/0170740 | A1 * | 7/2008 | Gantz | 381/380 |
| 2008/0317274 | A1 | 12/2008 | Kim | |
| 2009/0016559 | A1 | 1/2009 | Cleary | |
| 2010/0166207 | A1 | 7/2010 | Masuyama | |

FOREIGN PATENT DOCUMENTS

| | | | |
|---|---|---|---|
| EP | 1833275 | A2 | 9/2007 |
| EP | 1 954 012 | A1 | 8/2008 |
| GB | 2328580 | A | 2/1999 |
| GB | 2354755 | A | 4/2001 |
| JP | 2002325126 | A | 11/2002 |
| JP | 2003153365 | A * | 5/2003 |
| JP | 2003324784 | A | 11/2003 |
| JP | 2005252579 | A | 9/2005 |
| WO | WO 02/056570 | A1 | 7/2002 |
| WO | WO 2005/022560 | A1 | 3/2005 |
| WO | WO 2008/086279 | A2 | 7/2008 |

OTHER PUBLICATIONS

International Search Report mailed Oct. 26, 2010 in PCT Application No. 2010/045905 (4 pages).
Written Opinion of the International Searching Authority mailed Oct. 26, 2010 in PCT Application No. 2010/045905 (7 pages).

* cited by examiner

*Primary Examiner* — Curtis Kuntz
*Assistant Examiner* — Ryan Robinson
(74) *Attorney, Agent, or Firm* — K&L Gates LLP

(57) ABSTRACT

Various embodiments are directed to earphones, earphone assemblies, and methods of using the same. Further, these embodiments provide earphones that can releasably interconnect in a compact configuration that also reduces the likelihood that the earphone wires or cords will become entangled. By way of example, in at least one embodiment, an earphone can comprise a housing including a channel defined therein and a wire stem extending from the housing. The channel may be sized and configured to releasably retain a wire stem portion from another earphone. These and other various embodiments are described herein.

19 Claims, 8 Drawing Sheets

INTERCONNECTING EARPHONES

BACKGROUND

The present application relates generally to an earphone set and, in particular, earphone sets having two earphones that can be releasably connected together.

Earphones are usually a pair of small loudspeakers that are provided with a mechanism to hold them close to a user's ears and a means (e.g., an audio jack) to connect them to a signal source such as an audio amplifier, radio, or portable audio device, such as a CD or MP3 player. Typically, each earphone includes a wire or cord connecting each one together and/or to the audio jack.

SUMMARY

In various embodiments, an earphone assembly is provided. In at least one embodiment, an earphone assembly can comprise a first earphone including a first housing comprising a first groove defined therein, a first wire stem extending from the first housing, a first housing end located on the first housing opposite from the first wire stem, and a first stem end located on the first wire stem opposite from the first housing. In these embodiments, the earphone assembly further comprises a second earphone including a second housing including a second groove defined therein, a second wire stem extending from the second housing, a second housing end located on the second housing opposite from the second wire stem, and a second stem end located on the second wire stem opposite from the second housing. The earphone assembly also includes a first wire protruding from the first wire stem and a second wire protruding from the second wire stem. Further, in these embodiments, the first groove is sized and configured to releasably engage and at least partially envelop the second wire stem. Likewise, the second groove is sized and configured to releasably engage and at least partially envelop the first wire stem. Moreover, in these embodiments, the first groove and the second groove are configured to simultaneously engage the second wire stem and the first wire stem, respectively, to interconnect the first earphone and the second earphone. Additionally, in these embodiments, the first groove and the second groove are arranged such that when the first earphone and the second earphone are interconnected, the first wire and the second wire are oriented away from each other. Further, in these embodiments, the first earphone and the second earphone are sized and configured such that when the first earphone and the second earphone are fully interconnected, the distance between the first stem end and the second stem end is less than the distance between the first housing end and the second housing end.

In at least one embodiment, an earphone is provided that can comprise a housing including first channel defined therein and a wire stem extending from the housing. In these embodiments, the first channel is sized and configured to releasably retain a wire stem portion from another earphone.

In various embodiments, a method of connecting two earphones together is provided. In at least one embodiment, the method can comprise the step of providing a first earphone and a second earphone. In these embodiments, the first earphone includes a first wire stem extending from a first housing, and the second earphone includes a second housing comprising a groove defined therein. Further, in these embodiments, the method can further comprise the step of moving the first wire stem into the groove of the second earphone such that the first earphone is releasably connected to the second earphone.

This summary is intended to briefly outline certain embodiments of the subject application. It should be understood that the subject application is not limited to the embodiments disclosed in this summary, and is intended to cover modifications that are within its spirit and scope, as defined by the claims.

FIGURES

The novel features of the various embodiments are set forth with particularity in the appended claims. The various embodiments, however, both as to organization and methods of operation, may best be understood by way of example with reference to the following description, taken in conjunction with the accompanying drawings as follows.

DESCRIPTION

Figure 1:
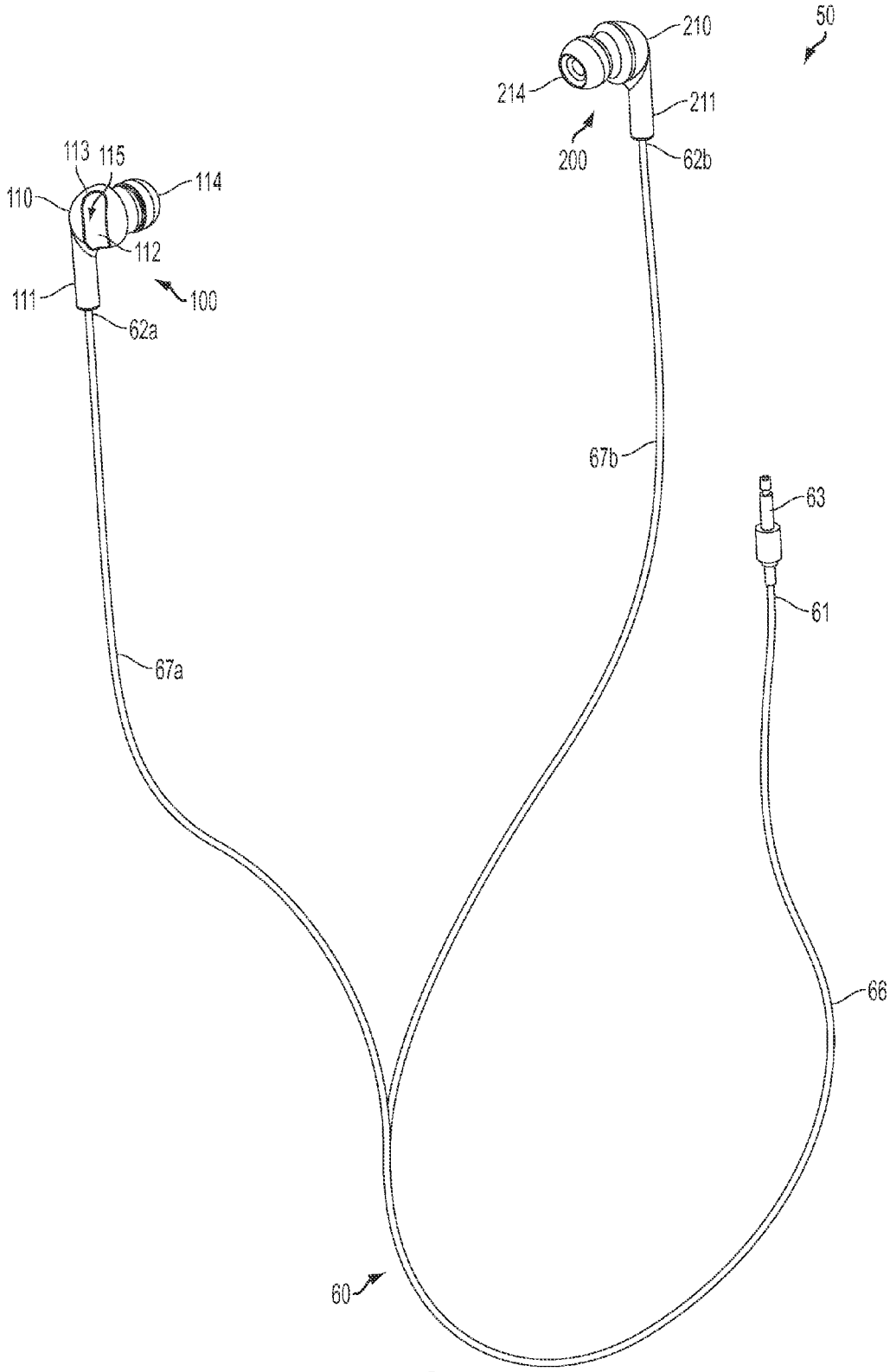
FIG. 1 is a front perspective view of a non-limiting embodiment of an earphone assembly including two earphones in a separated configuration.

Certain exemplary embodiments will now be described to provide an overall understanding of the principles of the structure, function, manufacture, and use of the devices and methods disclosed herein. One or more examples of these embodiments are illustrated in the accompanying drawings. Those of ordinary skill in the art will understand that the devices and methods specifically described herein and illustrated in the accompanying drawings are non-limiting exemplary embodiments and that the scope of the various embodiments of the present application is defined solely by the claims. The features illustrated or described in connection with one exemplary embodiment may be combined with the features of other embodiments. Such modifications and variations are intended to be included within the scope of the present application.

Before explaining the various embodiments in detail, it should be noted that the embodiments are not limited in their application or use to the details of construction and arrangement of parts illustrated in the accompanying drawings and description. The illustrative embodiments may be implemented or incorporated in other embodiments, variations, and modifications, and may be practiced or carried out in various ways. The following description, in conjunction with the accompanying drawings, are intended to convey all such modifications and variations.

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms. The description below is for the purpose of describing various embodiments and is not intended to limit the subject application thereto.

The various embodiments described herein are directed to earphones, earphone assemblies, and methods of using the same. Focusing now on at least one embodiment, an earphone assembly is provided that includes two earphones with a cord or wire protruding from each earphone. In various embodiments, the earphone assembly may be worn by a user, with one earphone in each of the user's ears for listening to audio sounds produced by a speaker or audio transducer of the earphone. The speakers may convert electrical signals to sound for listening by the user when the earphones are worn. The electrical signals for the audio sounds may originate from a source connected to the earphone assembly, such as a digital media player, for example. While in use, a wire from one earphone typically drapes down from the user's ear and makes little contact with the wire from the other earphone. However, when in storage, the wire of each earphone can become tangled with the other because the earphones may be in close proximity, and yet each earphone can also float freely, apart from its counterpart.

To at least partially ameliorate the above issues, the various embodiments of the present application provide earphones that can releasably interconnect in a compact configuration that also reduces the likelihood that the earphone wires will become entangled. By way of example, in at least one embodiment, an earphone can comprise a housing including a channel or groove defined on the exterior of the housing and a wire stem extending from the housing. The channel may be sized and configured to releasably retain a wire stem portion from another earphone. These and other embodiments are now illustrated and described with reference to the following figures.

Referring now to FIG. 1, an earphone assembly 50 may include a wire or cord 60 and a pair of earphones, e.g., first earphone 100 and second earphone 200. The cord 60 comprises a first end 61, an electrical connector 63 located at the first end 61, and a pair of second ends 62*a* and 62*b* protruding from each of the earphones 100, 200, respectively. The electrical connector 63 may connect the earphone assembly 50 to an audio source (not shown) such that electrical signals from the source may be conveyed through the cord 60, to each earphone 100, 200, where the electrical signal may be converted to audible sounds by a transducer (not shown), such as an audio loudspeaker that converts electrical voltage variations representing music or speech, to mechanical cone vibration, and hence vibrates air molecules creating sound.

As noted above, each earphone 100, 200 may be located at a respective second end 62*a*, 62*b* of the cord 60. The cord 60 further includes a first portion 66 adjacent to the first end 61 of the cord 60 and second portions 67*a* and 67*b* adjacent to the second ends 62*a* and 62*b*, respectively. The first portion 66 includes a single strand and the second portions 67*a*, 67*b* include separate strands such that the two earphones 100, 200 may be placed in the ears of a user, with each of second portions 67*a*, 67*b* on separate sides of the users head.

Figure 2:
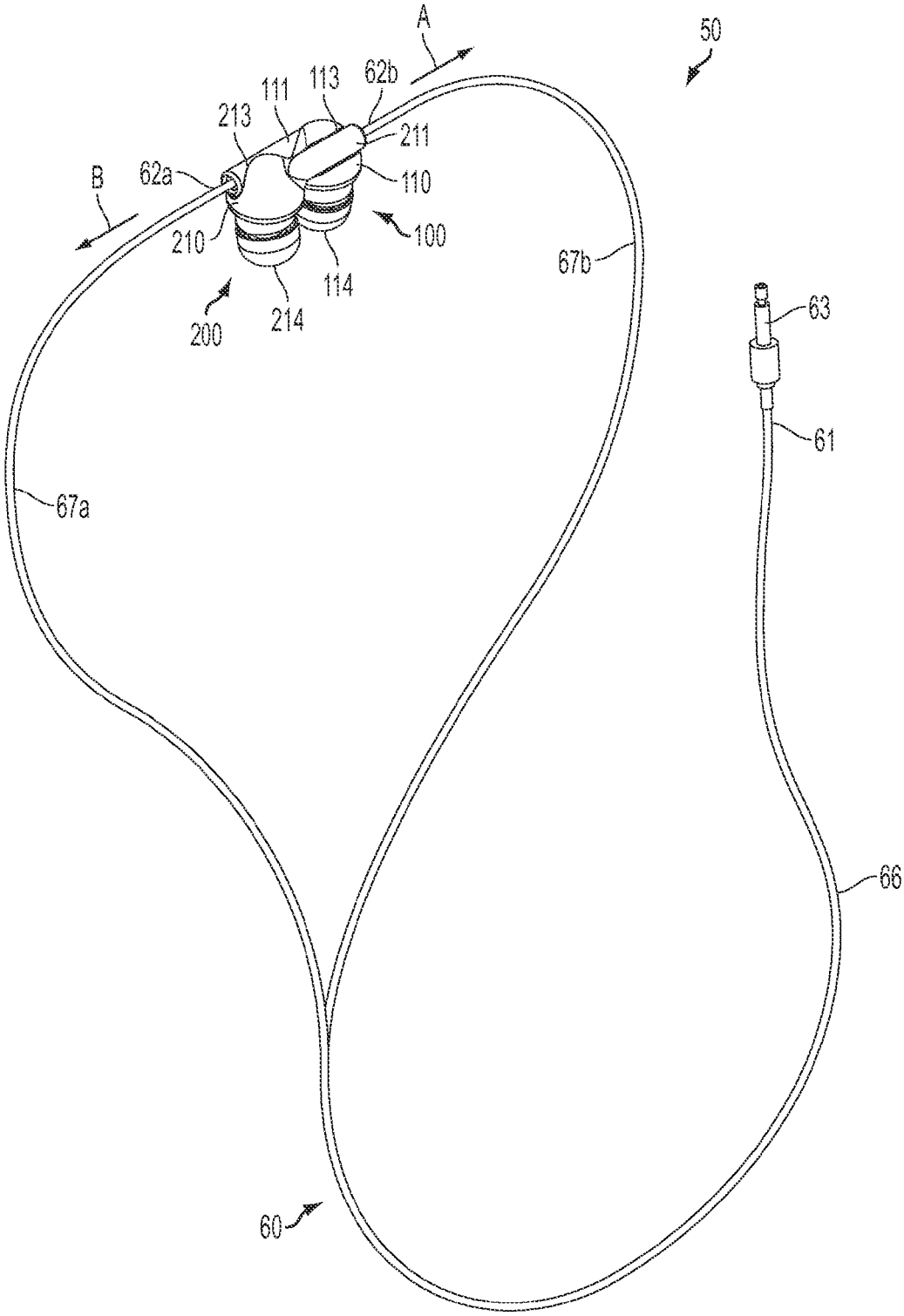
FIG. 2 is a front perspective view of the earphone assembly of FIG. 1 with the two earphones in an interconnected configuration.
Figure 3:
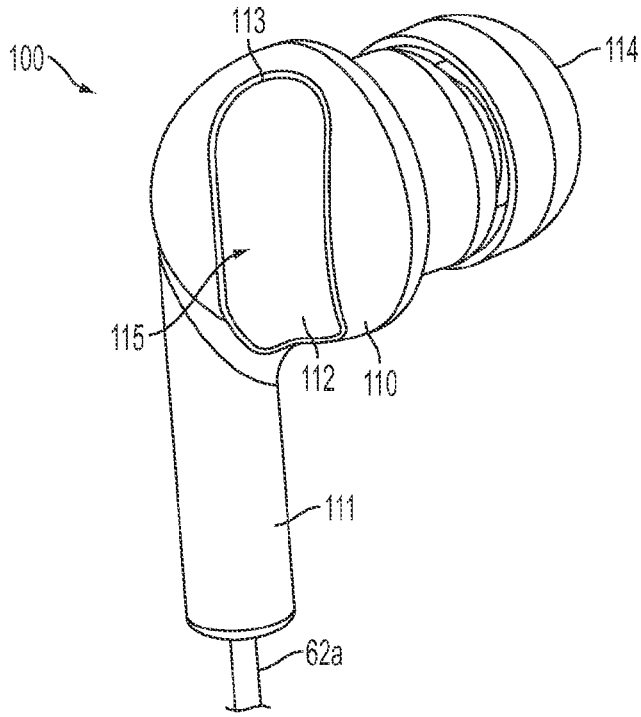
FIG. 3 is a front perspective view of one earphone of FIG. 1.
Figure 4:
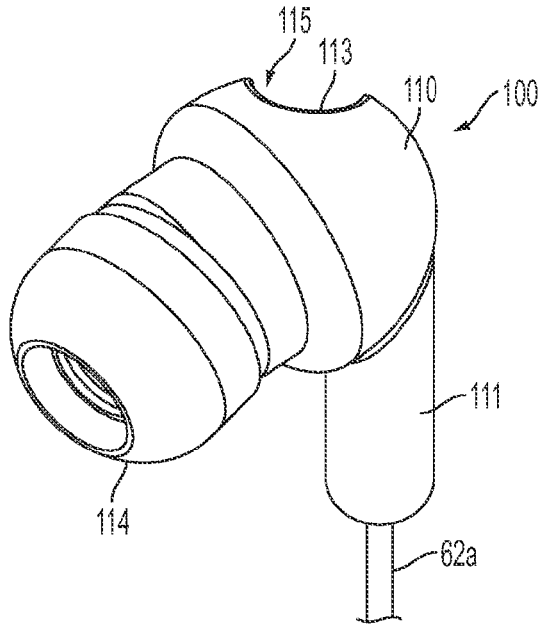
FIG. 4 is a back perspective view of the earphone of FIG. 3.
Figure 5:
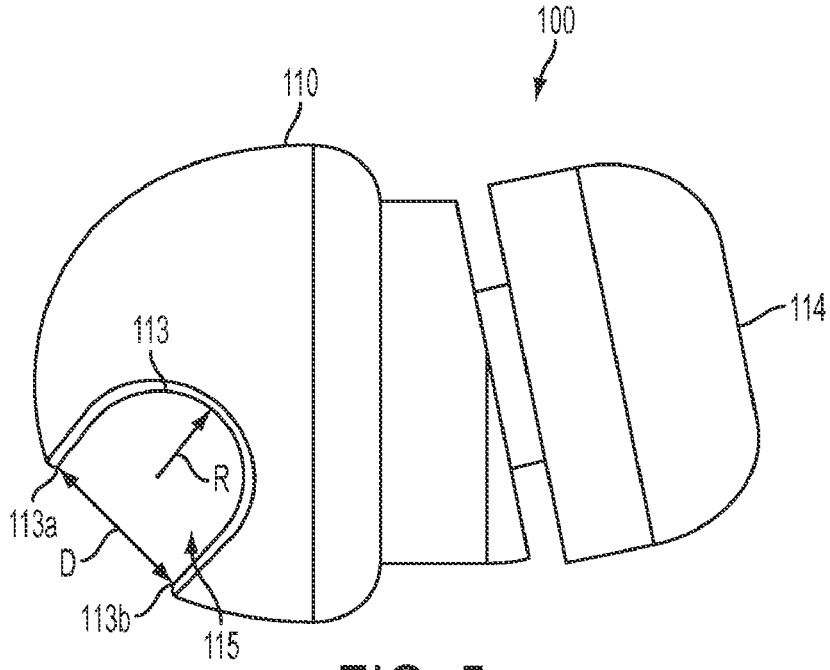
FIG. 5 is a top view of the earphone of FIG. 3.
Figure 6:
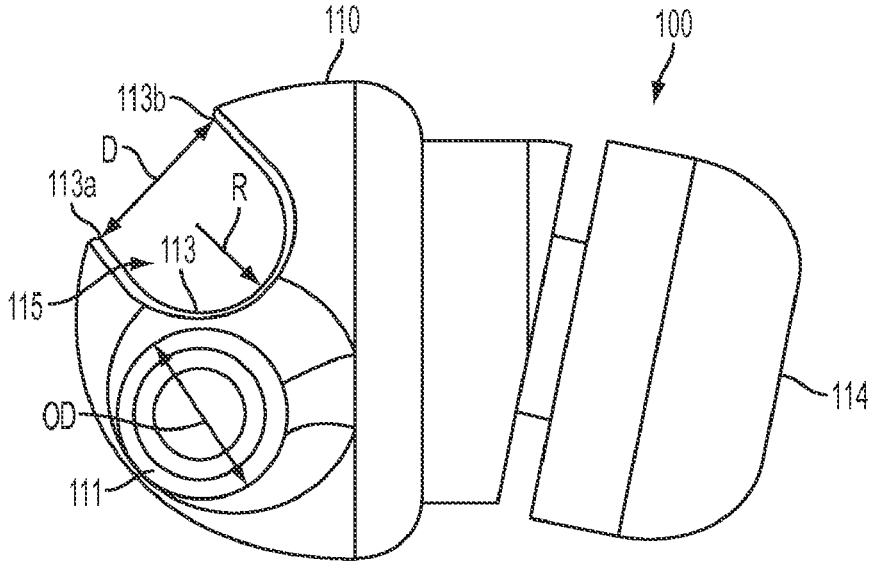
FIG. 6 is a bottom view of the earphone of FIG. 3.

Comparing FIGS. 1 and 2, in at least one embodiment, first earphone 100 and second earphone 200 may be in a separated configuration (FIG. 1) or in an interconnected configuration (FIG. 2). To facilitate the interconnection of earphones 100, 200 together, one or both of earphones 100, 200 may include a mount that releasably retains, receives, engages, or otherwise connects a portion of the first earphone 100 to a portion of the second earphone 200 and/or vice versa.

Focusing now on first earphone 100 illustrated in FIGS. 3-8, in various embodiments, a mount may include a channel or groove 115 defined in an exterior of earphone housing 110 by groove edge 113 and/or groove surface 112, for example. While not so limited, in at least one embodiment, the housing 110 generally houses the transducer, internal wiring, and/or conduits or passageways (not shown) for passing sound to the user's ear through earpiece 114 protruding from the housing 110. Earpiece 114 may be located on the opposite side of the housing from the groove 115. The earphone 100 may also include a wire stem 111 extending from the housing 110 for carrying internal wiring and/or a portion of cord 60 such as cord end 62*a*. As described in more detail below, the channel or groove 115 may be sized and configured to releasably retain, engage, receive, and/or connect to a portion of another earphone, such as a wire stem 211 of second earphone 200, see, e.g., FIG. 2.

Figure 9:
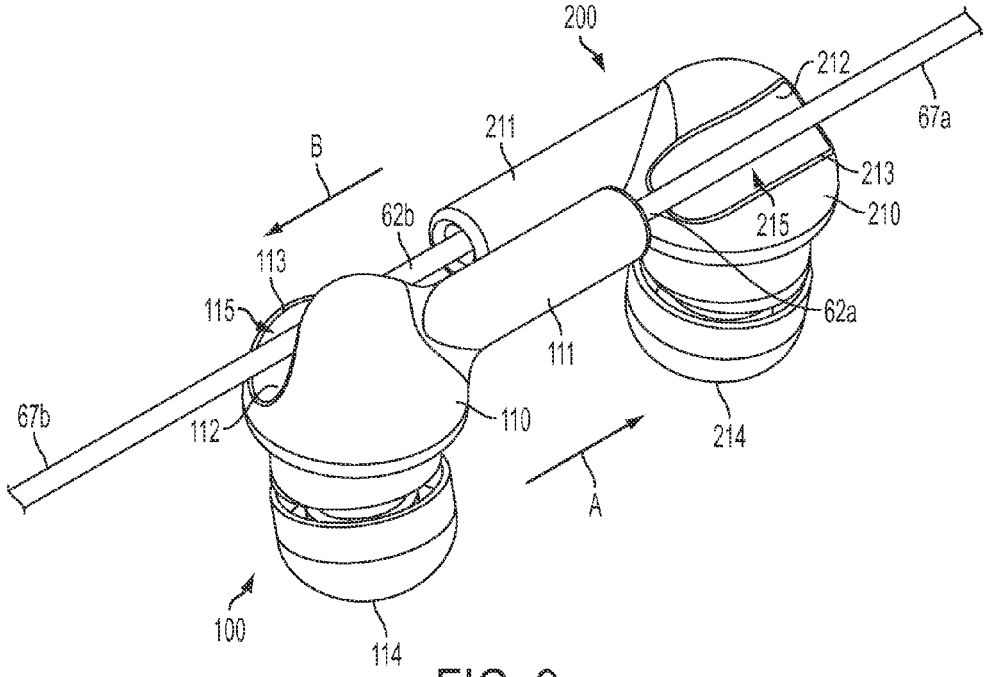
FIG. 9 is an enlarged perspective view of the earphones of FIG. 1 with the two earphones being arranged towards an interconnected configuration.

Referring to FIG. 9, second earphone 200 may likewise include a mount that is identical to the mount of the first earphone. For example, the second earphone 200 may include a channel or groove 215 defined in housing 210 by groove edge 213 and/or groove surface 212, for example. The earphone 200 may also include a wire stem 211 extending from the housing 210 for carrying internal wiring and/or a portion of cord 60 such as cord end 62*b*. Further, the second earphone 200 may include an earpiece 214 protruding from the housing 210. The second earphone 200 and/or its housing 210, wire stem 211, groove 215, and/or other associated components may be similar to that described above and below with respect to first earphone 100. For example, the second channel or groove 215 may also be sized and configured to releasably retain, engage, receive, and/or connect to a portion of another earphone, such as first wire stem 111 of first earphone 100. Further, as mentioned above, in various embodiments, portions of each earphone 100, 200 may be congruent in shape; that is, the shape of various portions of each earphone 100, 200 may be identical or nearly such when superimposed on one another. For example, the first groove 115 and the second groove 215 may be congruent in shape. Further, the first wire stem 111 and the second wire stem 211 may be congruent in shape. Additionally, the first housing 110 and the second housing 210 may be congruent in shape. Also, in at least one embodiment, all of the first earphone 100 and all of the second earphone 200 may be congruent in shape. In such embodiments, the two earphones 100, 200 may be nearly identical in shape, thus reducing manufacturing time and costs and providing various other advantages, described below.

Figure 10:
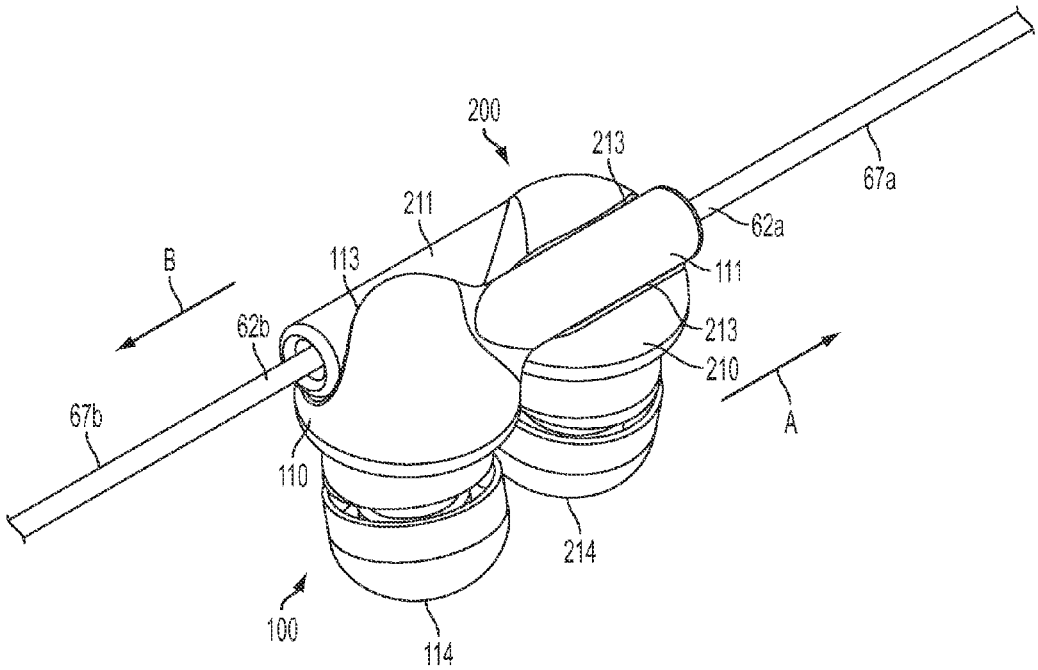
FIG. 10 is an enlarged perspective view of the earphones of FIG. 1 with the two earphones in an interconnected configuration.

Referring now to FIGS. 9 and 10, a method of connecting the two earphones 100, 200 together is illustrated. FIG. 9 shows the two earphones 100, 200 being arranged towards an interconnected configuration and FIG. 10 shows the two earphones in an interconnected configuration, similar to that shown in FIG. 2. Thus, in various embodiments, such a method may include the step of providing the first earphone 100 and the second earphone 200. The first earphone 100 may comprise first wire stem 111 extending from the first housing 110 and the second earphone 200 may include second housing 210 comprising groove 215 defined therein. In various embodiments, the method further includes the step of moving first wire stem 111 into groove 215 such that the first earphone 100 is releasably connected to the second earphone 200. For example, the step of moving may include, but is not limited to, sliding, snapping, embracing, nesting, enveloping, mounting, and/or otherwise connecting the first and second earphones 100, 200 together. Further, as seen in FIG. 9, in at least one embodiment, the first earphone may be moved or translated in the direction of arrow A and/or the second earphone may be moved or translated in the direction of arrow B such that first wire stem 111 is slid into second groove 215 and/or second wire stem 211 is slid into first groove 115. Alternatively, in at least one embodiment, the first earphone may be moved or translated in a direction transverse to arrow A and/or the second earphone may be moved or translated in a direction tranverse to arrow B such that the first wire stem 111 is snapped into second groove 215 and/or second wire stem 211 is snapped into first groove 115. In other embodiments, the earphones may also or alternatively be rotated or twisted together. Further, in at least one embodiment, the first groove 115 and the second groove 215 are configured to simultaneously engage the second wire stem 211 and the first wire stem 111, respectively, to interconnect the first earphone and the second earphone. In other words, the first wire stem 111 may be received in the second groove 215 and the second wire stem 211 may be received in the first groove, at the same or approximately the same time. Accordingly, after translating, sliding, snapping, rotating, twisting or otherwise connecting the two earphones 100, 200 together, the earphones 100, 200 may be attached together in an interconnected configuration, as seen in FIG. 10. The earphones 100, 200 may thereafter be pulled or twisted apart from each other to return to a separated configuration shown in FIG. 1 and also, subsequently, the first earphone 100 may be placed in a user's first ear and the second earphone may be placed in the user's second ear.

Referring to FIG. 10, in various embodiments, the earphones 100, 200 may be releasably held or locked together in an interconnected configuration. For instance, the first wire stem 111 may be held in the second groove 215 by friction between the surface of the wire stem 111 and the groove surface 212 or by interference between the surface of the wire stem 111 and the groove edge 213 and/or groove surface 212, see, e.g. FIG. 12. Further, in at least one embodiment, both friction and interference between the aforementioned surfaces may allow a secure, yet still releasable, hold or lock to be formed between the earphones 100, 200.

Figure 11:
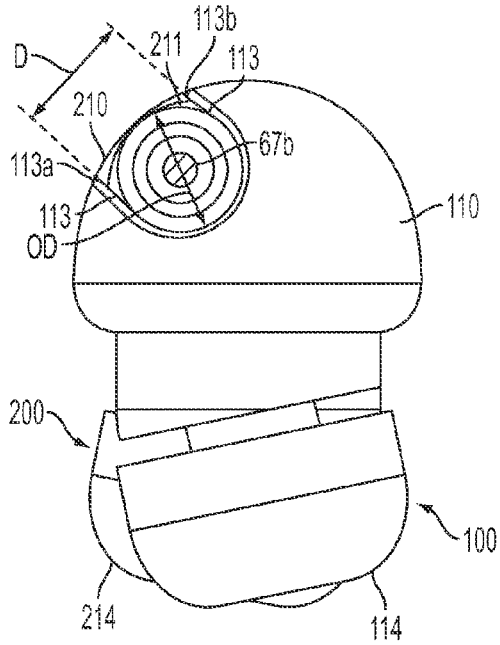
FIG. 11 is a back view of the interconnected earphones of FIG. 10.

In more detail, a friction-based hold and/or lock between earphones 100 and 200 may be provided in at least one embodiment. Focusing for the moment on first earphone 100 seen in FIGS. 5 and 6, the profile of groove 115 may be seen. The groove 115 may have a shape that includes a curvature having at least a radius R. In various embodiments, radius R may be sized the same as or larger than the outer diameter OD of the wire stem 211 of the second earphone 200, see FIG. 11. Focusing now on FIG. 11, in any event, the radius R of groove 115 may be sized such that when second wire stem 211 is placed in first groove 115, contact occurs between the surface of the wire stem 211 and the first groove surface 112, see also FIGS. 5-6. Accordingly, friction between the above-mentioned surfaces may hold second wire stem 211 in first groove 115 such that the earphones 100, 200 do not slide and/or rotate or are resisted from sliding and/or rotating uncontrollably in relation to each other. The second groove 215 may be likewise sized and configured to frictionally hold first wire stem 111. In embodiments where a portion or portions of earphone 100 are congruent with earphone 200, the grooves 115, 215 may each have a shape that includes the same radius R and/or the wire stems 111, 211 may also have the same outer diameter OD. Further, while the illustrated embodiments show a groove having a shape, a portion of which that approximates the shape of the wire stem it receives (e.g., the groove has a circular portion that substantially matches that of the wire stem), various additional embodiments are envisioned where the groove and its received wire stem do not have the same general shape. For example, no portion of the groove may be circular; rather it may include a polygonal portion instead, for example. Similarly, no portion of the wire stem may be circular; rather it may be polygonal instead, for example.

Also in more detail, an interference hold and/or lock between earphones 100 and 200 may be provided in at least one embodiment. Referring back to FIGS. 5-6, the first groove 115 may further have a shape that includes a distance D defined between groove apexes 113*a*, 113*b*. The distance D may be less than twice that of radius R and/or less than the outer diameter OD of the second wire stem 211, see FIG. 11. Accordingly, referring to FIG. 11, when the earphones 100, 200 are in an interconnected configuration, a portion of edge 113 and/or surface 112 of first groove 115 may physically interfere with the surface of second wire stem 211 and thereby prevent or resist second wire stem 211 from moving out of groove 115, past groove apexes 113*a*, 113*b*. In other words, the first groove 115 may be sized and configured to not only releasably engage the second wire stem 211, but also to at least partially envelop the same. Similarly, second groove 215 may also be sized and configured to releasably engage and at least partially envelop the first wire stem 111. Each groove 115, 215 may further only partially envelop each one's respective wire stem 211, 111 to allow the wire protruding from each wire stem 111, 211, i.e. cord ends 62*a*, 62*b*, respectively to pass into and/or through the grooves 115, 215, see, e.g., FIG. 9, thereby allowing the user to easily interconnect the earphones 100, 200.

Figure 7:
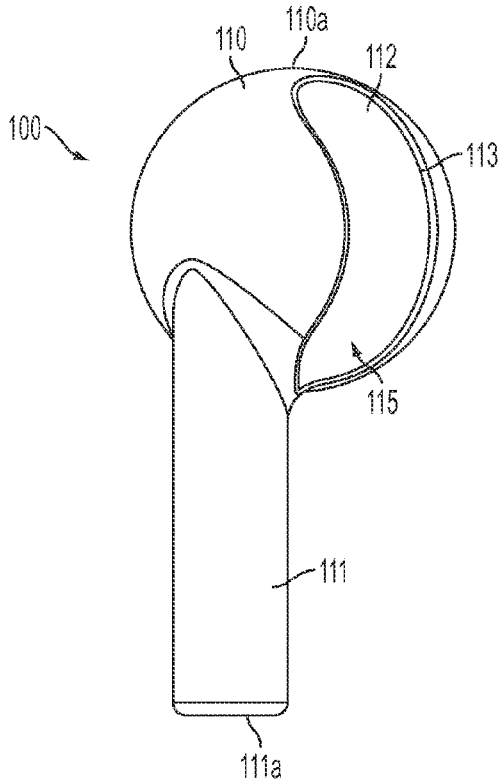
FIG. 7 is a back view of the earphone of FIG. 3.
Figure 8:
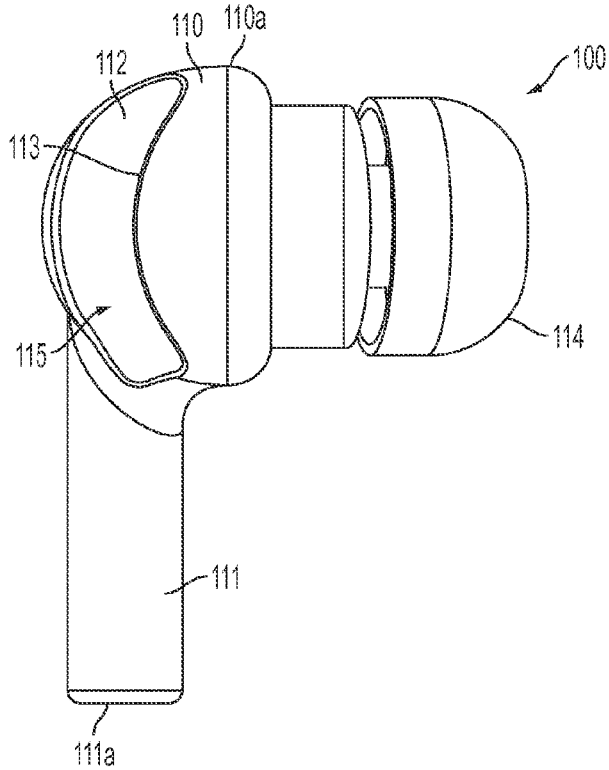
FIG. 8 is a side view of the earphone of FIG. 3.
Figure 12:
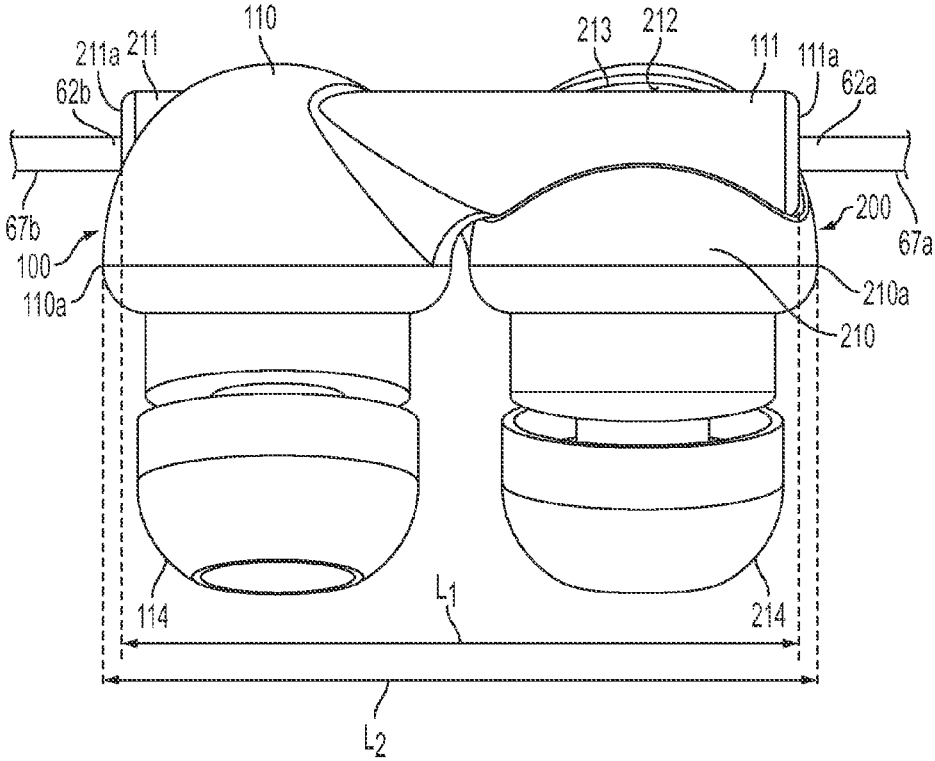
FIG. 12 is a side view of the interconnected earphones of FIG. 10.
Figure 13:
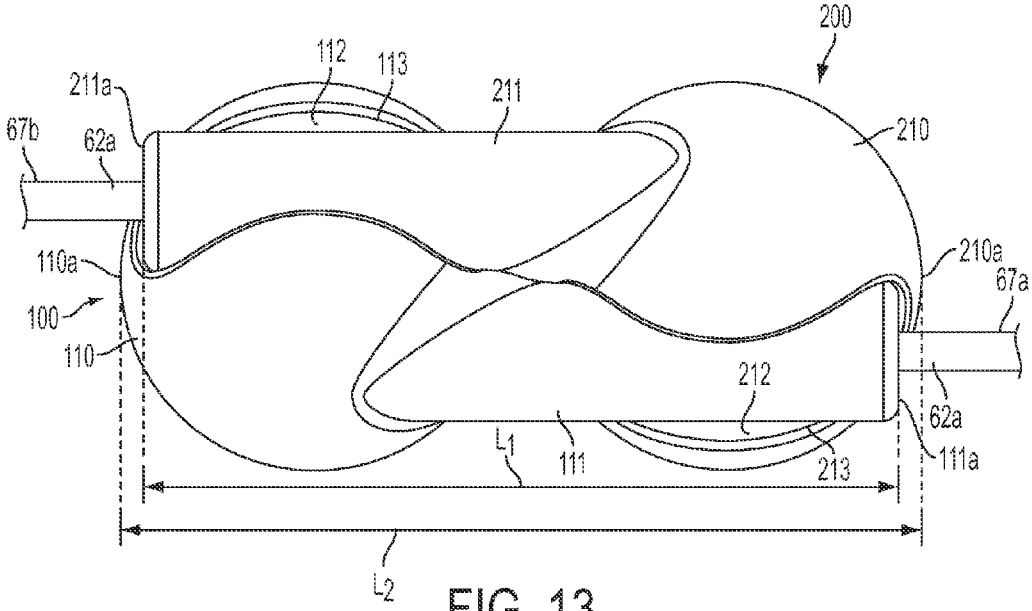
FIG. 13 is a top view of the interconnected earphones of FIG. 10.
Figure 14:
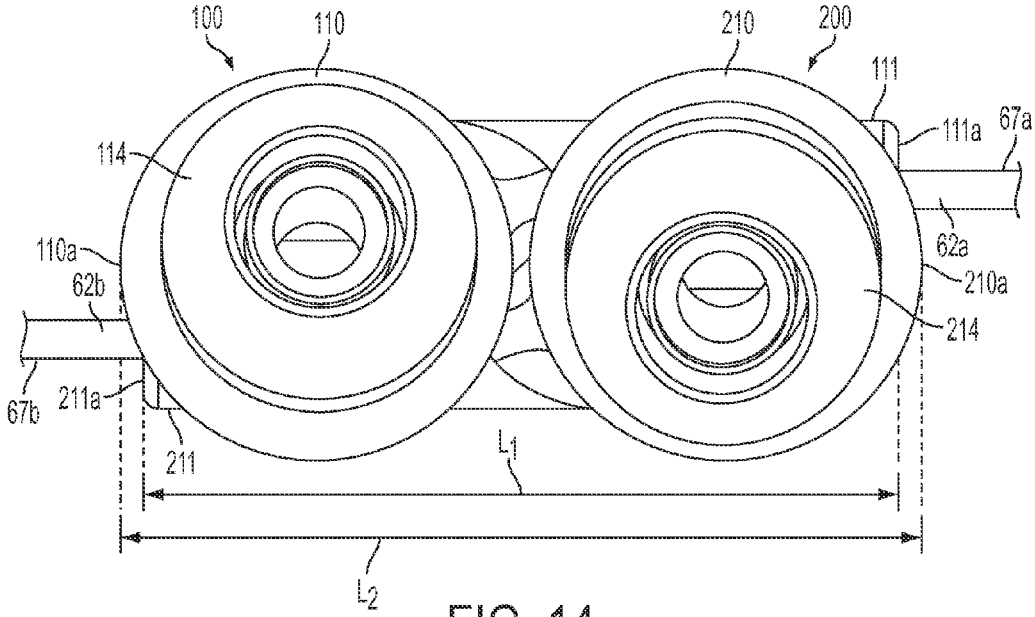
FIG. 14 is a bottom view of the interconnected earphones of FIG. 10.

In various embodiments, to reduce storage space, when in an interconnected configuration, the earphones 100, 200 may also be compact. Focusing now on the first earphone 100 as depicted in FIGS. 7-8, the earphone 100 may include a housing end 110*a* located on the housing 110, opposite from the wire stem 111. Further, the first earphone 100 may include a stem end 111 a located on the wire stem 111, opposite from the housing 110. Referring now to FIGS. 12-14, the second earphone 200 may likewise include a second housing end 210*a* and a second stem end 211*a* similarly positioned on the second earphone 200 as the first housing end 110*a* and the first stem end 111*a* are positioned on the first earphone 100.

Further, referring still to FIGS. 12-14, the first earphone 100 and/or the second earphone 200 may be sized and configured such that when they are fully interconnected, or when the first groove 115 maximally engages the second wire stem 211 and/or when the second groove 215 maximally engages the first wire stem 111, the distance $L_1$ between the first stem end 111*a* and the second stem end 211*a* is less than the distance $L_2$ between the first housing end 110*a* and the second housing end 210*a*. In other words, in at least one embodiment, the overall storage space required by the earphones 100, 200 when interconnected, is significantly decreased because the wire stems 111, 211 are nested into the housings 210, 110 via grooves 215, 115, respectively.

Further to the above, the interconnected configuration, as shown in FIGS. 2 and 10, for example, provides various additional benefits. For instance, such an interconnected configuration prevents the first and second earphones 100, 200 from substantially translating with respect to each other when stored to prevent (or reduce the likelihood that) the second portions 67*a* and 67*b* of cord 60 from becoming tangled, knotted, or otherwise undesirably intertwined. This allows the two earphones 100, 200 to be removed from storage and separated from each other to a separated configuration, as shown in FIG. 1, while reducing the likelihood that a user will need to detangle or unknot all or a portion of the cord 60 before wearing and/or using the earphone assembly 50.

Referring still to FIGS. 2 and 10, the orientation of the earphones 100, 200 when interconnected also provides various advantages. For example, the first groove 115 and the second groove 215 (see FIG. 9, for example) may be arranged such that when the first groove 115 engages the second wire stem 211, a first wire protruding from the first wire stem 111, e.g., cord end 62*a*, and a second wire protruding from the second wire stem 211, e.g., cord end 62*b*, are oriented away from each other. In other words, when earphones 100, 200 are interconnected the cord ends 62*a* and 62*b* may be directed in different directions. As seen in FIGS. 2 and 10, the cord end 62*a* is directed from first wire stem 111 in the direction of arrow A and the other cord end 62*b* is directed from the second wire stem 211 in the direction of arrow B. Thus, when earphones 100, 200 are interconnected, the cord end 62*a* is oriented in a direction that is 180 degrees from the direction in which cord end 62*b* is oriented. Alternatively, the first groove 115 and/or second groove 215 may be configured such that, when earphones 100, 200 are interconnected, the cord ends 62*a* and 62 are still oriented away from each other, i.e., at an angle greater than zero degrees but at an angle less than or equal to an angle of 180 degrees.

Additionally, referring to FIG. 2, in embodiments where the cord ends 62*a*, 62*b* are oriented away from each other when the earphones 100, 200 are in an interconnected configuration, the probability that the cord portions 67*a*, 67*b* may become entangled is further diminished. This is in part due to the fact that, in such embodiments, the cord portions 67*a*, 67*b* are directed away and thus kept apart from each other over a greater distance of their lengths when stored or otherwise not in use than in situations where the cord portions may be directed in the same direction.

Although various embodiments have been described herein, many modifications and variations to those embodiments may be implemented. In addition, combinations of the described embodiments may be used. Also, where materials are disclosed for certain components, other materials may be used. The foregoing description and following claims are intended to convey and cover all such modification and variations.

What is claimed is:

1. An earphone assembly, comprising:

a first earphone comprising:

a first housing including a first speaker on a first front side of the first housing and a first groove defined in a first back side of the first housing;

a first wire stem extending from the first housing;

a first housing end located on the first housing opposite from the first wire stem; and a first stem end located on the first wire stem opposite from the first housing;

a first wire protruding from the first wire stem;

a second earphone comprising:

a second housing including a second speaker on a second front side of the second housing and a second groove defined in a second back side of the second housing;

a second wire stem extending from the second housing;

a second housing end located on the second housing opposite from the second wire stem; and a second stem end located on the second wire stem opposite from the second housing; and a second wire protruding from the second wire stem;

wherein the first groove is sized and configured to releasably engage and at least partially envelop the second wire stem and the second groove is sized and configured to releasably engage and at least partially envelop the first wire stem, wherein the first groove and the second groove are configured to simultaneously engage the second wire stem and the first wire stem, respectively, to interconnect the first earphone and the second earphone;

wherein the first groove and the second groove are arranged such that when the first earphone and the second earphone are interconnected the first speaker is directed away from the second wire stem, the second speaker is directed away from the first wire stem, and the first wire and the second wire are oriented away from each other; and wherein the first earphone and the second earphone are sized and configured such that when the first earphone and the second earphone are fully interconnected, the distance between the first stem end and the second stem end is less than the distance between the first housing end and the second housing end.

2. The earphone assembly of claim 1, wherein the first groove and the second groove are congruent in shape.

3. The earphone assembly of claim 2, wherein the first wire stem and the second wire stem are congruent in shape.

4. The earphone assembly of claim 3, wherein the first housing and the second housing are congruent in shape.

5. The earphone assembly of claim 4, wherein the first earphone and the second earphone are congruent in shape.

6. The earphone assembly of claim 1, wherein the first groove is configured to slideably engage the second wire stem and wherein the second groove is configured to slideably engage the first wire stem.

7. The earphone assembly of claim 1, wherein the first groove is configured to engage the second wire stem in a snap-fit fashion and wherein the second groove is configured to engage the first wire stem in a snap-fit fashion.

8. The earphone assembly of claim 1, wherein the first groove is configured to frictionally engage the second wire stem and wherein the second groove is configured to frictionally engage the first wire stem.

9. An earphone assembly, comprising:

a first earphone comprising:

a first housing including a first earpiece on a first front side of the first housing and a first channel defined in a first back side of the first housing; and a first wire stem extending from the first housing;

a first wire protruding from the first wire stem;

a second earphone comprising:

a second housing including a second earpiece on a second front side of the second housing and a second channel defined in a second back side of the second housing; and a second wire stem extending from the second housing; and a second wire protruding from the second wire stem;

wherein the first channel is sized and configured to releasably engage the second wire stem and the second channel is sized and configured to releasably engage the first wire stem, wherein the first channel and the second channel are configured to simultaneously engage the second wire stem and the first wire stem, respectively, to interconnect the first earphone and the second earphone; and wherein the first channel and the second channel are arranged such that when the first earphone and the second earphone are interconnected the first earpiece is directed away from the second wire stem, the second earpiece is directed away from the first wire stem, and the first wire and the second wire are oriented away from each other.

10. The earphone assembly of claim 9, wherein the first channel is sized and configured to at least partially envelop the second wire stem.

11. The earphone assembly of claim 9, further comprising a first housing end located on the first housing opposite from the first wire stem, a first stem end located on the first wire stem opposite from the first housing, a second housing end located on the second housing opposite from the second wire stem, and a second stem end located on the second wire stem opposite from the second housing, wherein the second earphone is sized and configured such that when the first channel maximally retains the second wire stem and when the second channel maximally retains the first wire stem, the distance between the first stem end and the second stem end is less than the distance between the first housing end and the second housing end.

12. The earphone assembly of claim 9, wherein the first channel and the second channel are congruent in shape.

13. The earphone assembly of claim 12, wherein the first wire stem and the second wire stem are congruent in shape.

14. The earphone assembly of claim 13, wherein the first housing and the second housing are congruent in shape.

15. The earphone assembly of claim 9, wherein the first channel is configured to slideably retain the second wire stem.

16. The earphone assembly of claim 9, wherein the first channel is configured to retain the second wire stem in a snap-fit fashion.

17. The earphone assembly of claim 9, wherein the first earpiece protrudes from the first housing, and wherein the first earpiece is located on the opposite side of the first housing from the first channel.

18. A method of using two earphones, the method comprising the step of:

moving a first wire stem of a first earphone into a second groove of a second earphone, such that the first earphone is releasably connected to the second earphone, wherein the first wire stem extends from a first housing of the first earphone and wherein the second groove is defined in a second housing of the second earphone; and moving a second wire stem of the second earphone into a first groove of the first earphone, such that the second earphone is releasably connected to the first earphone, wherein the second wire stem extends from the second housing of the second earphone and wherein the first groove is defined in the first housing of the first earphone;

wherein the first groove and the second groove are arranged such that when the first earphone and the second earphone are releasably connected to each other a first earpiece of the first earphone is directed away from the second wire stem, a second earpiece of a second earphone is directed away from the first wire stem, and the first wire stem and the second wire stem are oriented away from each other.

19. The method of claim 18, further comprising the steps of separating the first earphone from the second earphone and placing the first earphone in a user's first ear and the second earphone in the user's second ear.

* * * * *

UNITED STATES PATENT AND TRADEMARK OFFICE

CERTIFICATE OF CORRECTION

PATENT NO. : 8,249,286 B2
APPLICATION NO. : 12/546328
DATED : August 21, 2012
INVENTOR(S) : Brad Nault It is certified that error appears in the above-identified patent and that said Letters Patent is hereby corrected as shown below:

COL. 6, LINE 42

Delete "end 111 a located on the wire stem" and substitute therefor --end 111a located on the wire stem--.

Signed and Sealed this
Twenty-fifth Day of December, 2012

David J. Kappos

David J. Kappos
*Director of the United States Patent and Trademark Office*